US011744416B2

(12) United States Patent
Cai

(10) Patent No.: US 11,744,416 B2
(45) Date of Patent: Sep. 5, 2023

(54) LINT REMOVING DEVICE

(71) Applicant: GUANGDONG DEERMA TECHNOLOGY CO., LTD., Foshan (CN)

(72) Inventor: Yanqiang Cai, Foshan (CN)

(73) Assignee: GUANGDONG DEERMA TECHNOLOGY CO., LTD., Foshan (CN)

( * ) Notice: Subject to any disclaimer, the term of this patent is extended or adjusted under 35 U.S.C. 154(b) by 843 days.

(21) Appl. No.: 16/719,943

(22) Filed: Dec. 18, 2019

(65) Prior Publication Data

US 2020/0323405 A1 Oct. 15, 2020

Related U.S. Application Data

(63) Continuation-in-part of application No. PCT/CN2019/082044, filed on Apr. 10, 2019, and a continuation-in-part of application No. PCT/CN2019/082065, filed on Apr. 10, 2019.

(51) Int. Cl.
*A47L 5/14* (2006.01)
*A47L 25/08* (2006.01)

(52) U.S. Cl.
CPC ..... *A47L 5/14* (2013.01); *A47L 25/08* (2013.01)

(58) Field of Classification Search
CPC ... A47L 5/14; A47L 25/08; A47L 5/24; A47L 25/00
USPC ..... 15/22.1, 23, 24, 29, 416, 105, 106, 15/104.002
See application file for complete search history.

(56) References Cited

U.S. PATENT DOCUMENTS 5,894,624 A * 4/1999 Fulenwider ..... B44D 3/164 7/105

FOREIGN PATENT DOCUMENTS

| | | | |
|---|---|---|---|
| CN | 201058013 | Y | 5/2008 |
| CN | 202027553 | U | 11/2011 |
| CN | 202139443 | U | 2/2012 |
| CN | 202193979 | U | 4/2012 |
| CN | 202408815 | U | 9/2012 |
| CN | 202830532 | U | 3/2013 |
| CN | 103233336 | A | 8/2013 |
| CN | 204589615 | U | 8/2015 |
| CN | 204644692 | U | 9/2015 |
| CN | 106388755 | A | 2/2017 |
| CN | 206792372 | U | 12/2017 |

(Continued)

*Primary Examiner* — David Redding
(74) *Attorney, Agent, or Firm* — Bayramoglu Law Offices LLC

(57) ABSTRACT

A lint removing device, includes a body, a handle connected to the body, and a lint removing assembly located in the body. The handle is hollow with an opening at one end, while the other end of the handle is connected to an outer wall of the body. The handle includes an extended functional structure, and the extended functional structure includes a fixed portion and a protruding portion. The fixed portion is placed inside the handle. The protruding portion extends out of the handle opening for the extended function, and the protruding portion is fixed in the handle by the fixed portion after the protruding portion is retracted in the handle. The lint removing device with an extended function of the handle enables the lint removing device to expand other functions in addition to the lint removing function.

11 Claims, 14 Drawing Sheets

(56) References Cited

FOREIGN PATENT DOCUMENTS

| | | | |
|---|---|---|---|
| CN | 206867204 | U | 1/2018 |
| CN | 207055471 | U | 3/2018 |
| CN | 108742473 | A | 11/2018 |
| CN | 108852259 | A | 11/2018 |
| CN | 208740917 | U | 4/2019 |
| JP | 2004256955 | A | 9/2004 |
| JP | 2016148120 | A | 8/2016 |

* cited by examiner

LINT REMOVING DEVICE

CROSS REFERENCE TO THE RELATED APPLICATIONS

This application is the continuation-in-part application of International Application No. PCT/CN2019/082044, filed on Oct. 4, 2019, and International Application No. PCT/CN2019/082065, filed on Oct. 4, 2019, which are based upon and claims priority to Chinese Patent Application No. 201811009194.6, filed on Aug. 31, 2018, Chinese Patent Application No. 201811009191.2, filed on Aug. 31, 2018, and Chinese Patent Application No. 201821419661.8, filed on Aug. 31, 2018, the entire contents of which are incorporated herein by reference.

TECHNICAL FIELD

The present disclosure relates to the field of small household appliances, and particularly to a lint removing device having a structure for sticking lint.

BACKGROUND

Clothing and common household fabrics that are rubbed together during washing or use would accumulate textile fibers, thereby forming lint on the surface of the fabric. In order to prevent lint from affecting the appearance of the fabric, a lint removing device is generally employed to remove the lint.

The lint removing device is a commonly used small household appliance. The existing lint removing device is designed to be a compact, convenient and delicate device, and requires small storage space. The lint removing device is hand-held, and the handle is designed to facilitate the application of force. The early lint removing devices generally do not utilize the space inside of the handle as the handles have no additional functional components. With the development of technology, two design ideas have emerged. The first design idea is to cancel the distinct handle design, wherein, the grip part of the lint removing device is designed to be connected to the body of the lint removing device, so the body of the lint removing device can be directly griped during use. The second design idea is to retain the handle design and utilize the internal space of the handle wherein, functional components are provided within the handle. For example, a switch button may be arranged on the handle, the inside of the handle may contain control parts, or in suction type lint removing devices, the handle may be used as a storage chamber for the collected items. Other ways to utilize the lint removing device handle could be a rotatable and adjustable handle for convenience and comfort during use. The internal space of the handle is utilized as a storage chamber, which can provide a large storage space for the lint removing device. However, utilizing the handle space as lint storage is unnecessary given the fact that the lint removing device only requires small storage space. Similarly, the adjustable and rotatable handle are unnecessary for a lint removing device given the fact that, clothing can be placed on a plane to remove lint using the lint removing device which removes any need for adjusting the handle.

A lint trimmer is disclosed in the prior art, wherein a roller structure for sticking to lint is fixed on an outer housing of the lint trimmer, trimming the lint on the clothing and simultaneously sticking the lint. It appears that the lint trimmer is able to both trim and stick to lint, but in reality, to achieve the simultaneous action of trimming and sticking the lint, the user must go to great lengths. When trimming the lint, the user has to pay attention to the position in order for the roller to stick and pick up the lint. When the roller is not in use, the roller cannot be stored inside the lint trimmer, causing an unnecessary waste of space. Furthermore, users often do not concurrently use both functions when using the lint removing device and the roller for sticking the lint, and the two structures may even interfere with each other, causing great inconvenience during use.

SUMMARY

In order to solve the foregoing technical problems, the present disclosure provides a lint removing device with an additional handle functionality, thus expanding the use and adding other functions of the device outside of lint removal.

In order to achieve the above objective, the technical solutions of the present disclosure are as follows:

a lint removing device, including a body of the lint removing device, a handle connected to the body, and a lint removing assembly, wherein the lint removing assembly is arranged in the body; the handle is hollow and has an opening at one end, and the other end of the handle is connected to an outer wall of the body; the handle has an extended functional structure, and the extended functional structure includes a fixed portion and a protruding portion; the fixed portion is placed inside the handle; the protruding portion extends out of the handle from the opening and is used for the extended functional structure, and the protruding portion is fixed in the handle by the fixed portion after the protruding portion retracts into the handle.

The lint removing device according to the present disclosure includes the body of the lint removing device and the handle connected to the body on one end. The handle is hollow with an opening on the other end of the handle. The extended functional structure is inserted from the handle opening. In order to avoid affecting the installation of the extended functional structure in the handle, the conventional lint removing assemblies are integrally arranged in the body. Therefore, the handle of the present disclosure is not provided with any conventional lint removing assembly. The extended functional structure includes the fixed portion and the protruding portion. The protruding portion extends out of the handle from the opening and is used for the extended function, so the extended functional structure of the present disclosure is retractable. When the extended function structure not in use, the protruding portion can be placed inside the handle. The lint removing device of the present disclosure has a similar overall appearance as the conventional lint removing device, while fully utilizing the space inside the handle, thereby expanding other functions of the lint removing device in addition to trimming lint.

Further, the fixed portion includes a self-locking switch, and the protruding portion includes a lock catch matched with the self-locking switch. The protruding portion further includes a pressing portion that is easily pressed. The self-locking switch is existing in the prior art, wherein the self-locking switch enters a locked state and an unlocked state after being continuously pressed, and the self-locking switch is matched with the lock catch of the protruding portion, allowing the protruding portion to freely enter and exit at the opening of the handle. The pressing portion is arranged on the protruding portion and is adjacent to the opening for the convenience of pressing, so that the protruding portion can be easily pressed and conveniently unlocked from the self-locking switch. Consequently, when the protruding portion is pushed into the handle and is fixed, the pressing portion can also conveniently push the protruding portion without being obstructed by an outer housing of the handle.

Further, the lint removing assembly includes a mounting holder, wherein the mounting holder is fixed inside the body. A wall of the body is provided with a perforation at a position corresponding to the handle. The fixed portion includes a shrink-ring, wherein the shrink-ring is arranged through the perforation. The mounting holder is provided with a pin, and the pin is inserted into the shrink-ring so that the fixed portion is fixed to the lint removing device. The body and handle of the lint removing device is a housing. Due to the processing method of the existing housing, a fixed structure is unsuited to be mounted on the housing, thereby avoiding modifying a mold and increasing the complexity of the mold. Therefore, the shrink-ring of the fixed portion passes through the wall of the body and is fixed to the mounting holder. The mounting holder can be used to install other parts of the lint removing assembly, to connect and fix to the extended functional structure, and to fix the fixed portion. In addition, the pin is matched with the perforation and is inserted into the shrink-ring, so that the fixed portion is fixed in the body and the handle.

Further, the lint removing assembly further includes a suction type fan, the mounting holder is matched with the wall of the body so as to divide an inner chamber of the body into a first chamber and a second chamber. The suction type fan is installed inside the first chamber. The pin is arranged inside the second chamber, and the perforation and the second chamber communicate. The suction type fan can suck the lint trimmed by the lint removing device into the lint removing device, specifically, into the first chamber. The interior of the body is divided by the mounting holder into the first chamber and the second chamber, and the extended functional structure and a connecting fixed structure of the mounting holder are arranged in a corresponding area of the second chamber, so as to prevent the sucked lint from being blown into the interior of the handle.

Further, the body and the handle form into one piece.

Further, the protruding portion includes a guiding structure, wherein the guiding structure acts on the handle or the fixed portion. The guiding structure is matched with the handle or the fixed portion, so as to make the protruding portion move in a direction and prevent the protruding portion from freely shaking in the handle.

Further, the handle or the fixed portion is provided with a guiding groove, wherein the guiding groove is provided with a positioning protrusion at one end of the handle having the opening. The guiding structure is matched with the guiding groove and the positioning protrusion, so that the guiding structure slides in the guiding groove and is positioned and fixed by the positioning protrusion.

Further, the lint removing device includes a functional component, wherein the functional component is fixed on the protruding portion; or the protruding portion is the functional component.

Preferably, the lint removing device further includes a sticky lint roller, wherein the sticky lint roller is sleeved outside the protruding portion and is restricted by the protruding portion, and the sticky lint roller extends out of and retracts into the handle following with the protruding portion. The fixed portion and the protruding portion are arranged in the handle, the protruding portion extends out of the handle from the opening, the sticky lint roller is sleeved on the protruding portion and moves along with the protruding portion inside and outside the handle. As such, the normal function of the lint removing device is not affected by the sticky lint roller when the lint removing assembly is in normal use. When the sticky lint roller is in use, the protruding portion is taken out from the handle, and the sticky lint roller also extends out from the handle following with the protruding portion, and then is used to stick to the lint. Thus, the internal space of the lint removing device is fully utilized and the structure is more compact and practical.

Further, the fixed portion includes a support cylinder, wherein the protruding portion is sleeved on the support cylinder in a sliding manner. The support cylinder allows the support cylinder to move more steadily, and also facilitates to sleeve the sticky lint roller on the protruding portion.

Further, the protruding portion is provided with the guiding structure toward the support cylinder, and the guiding structure is matched with the support cylinder to guide the protruding portion.

Further, the support cylinder is provided with the guiding groove, wherein the guiding groove is provided with the positioning protrusion at one end of the handle having the opening, and the guiding structure is matched with the guiding groove and the positioning protrusion, so that the guiding structure slides in the guiding groove and is positioned and fixed by the positioning protrusion.

Further, the protruding portion includes a mounting area used for the installation of the sticky lint roller, wherein a limiting part configured to restrict a position of the sticky lint roller is arranged on both sides of the mounting area, thereby preventing the sticky lint roller from falling from the protruding portion when the sticky lint roller is in use.

Preferably, the limiting part on one side of the mounting area is detachable. The sticky lint roller can be removed after the limiting part is removed, so as to facilitate a replacement of the sticky lint roller.

Preferably, the lint removing device further includes a spring, wherein the spring is arranged inside the support cylinder, and one end of the spring abuts the protruding portion. The spring provides an elastic force for supporting the protruding portion and can be popped up after the self-locking switch is unlocked. Therefore, the protruding portion can be designed with more installation states with the handle. For example, the protruding portion is designed to be hidden. The protruding portion is placed in the handle and cannot be readily removed by hands, but at this time, the protruding portion can be pushed from the handle after being unlocked owing to the spring.

DETAILED DESCRIPTION OF THE EMBODIMENTS

Figure 1:
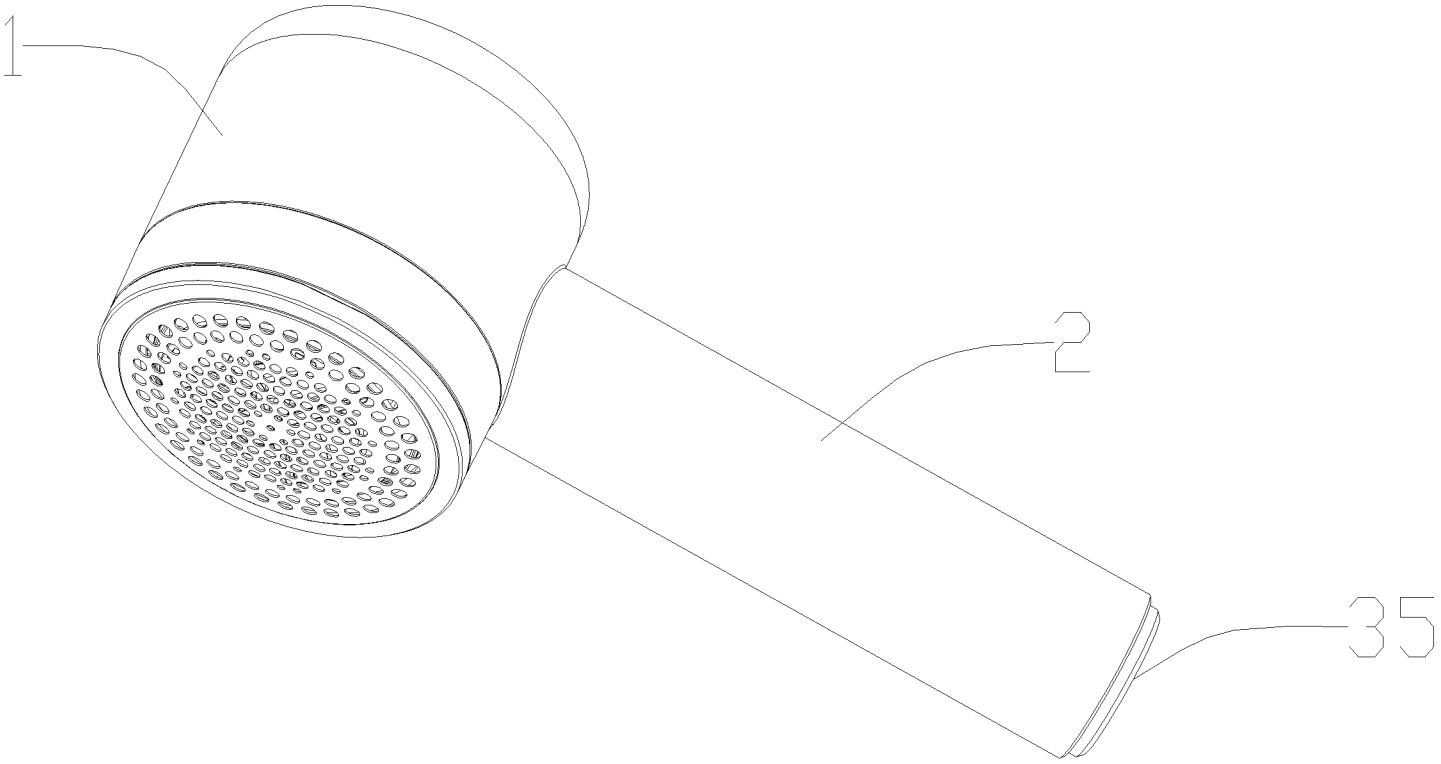
FIG. 1 is a perspective view showing a lint removing device of the present disclosure.

The lint removing device of the present disclosure will be described hereinafter with reference to the drawings.

As shown in FIGS. 1-8, the lint removing device includes the body 1 of the lint removing device and the handle 2 connected to the body 1. The body 1 and the handle 2 form into one piece, thereby forming the overall outer housing of the lint removing device. The body 1 is hollow and has an opening, which allows the lint removing assembly to be installed in the body 1. Similarly, the handle 2 is also hollow and has an opening 2*a* at one end, as shown in FIG. 9. The lint removing device further includes the sticky lint structure 3, wherein the sticky lint structure 3 can be installed in the handle 2 from the opening. The wall of the body 1 is provided with the perforation 16 at a position corresponding to the handle 2, so that the sticky lint structure 3 can pass through the perforation 16 and be fixed. The body 1 further includes the cover 17, wherein the cover 17 is covered at the opening, and the cover 17 can be disassembled, so as to facilitate the installation of the lint removing assembly.

The sticky lint structure 3 includes the fixed portion and the protruding portion, the protruding portion extends out of the handle 2 from the opening and is used for an extended function. The fixed portion fixes the protruding portion in the handle 2 after the protruding portion is retracted in the handle 2. The fixed portion includes the shrink-ring 324, wherein the shrink-ring 324 is arranged to pass through the perforation 16. The lint removing assembly includes the mounting holder 13 configured to install other parts of the lint removing assembly, and the mounting holder 13 can be matched with the body 1 and be fixed in the body 1. The mounting holder 13 is provided with the pin 131, and the position of the pin 131 is matched with the position of the shrink-ring 324. During the installation of the lint removing device, the shrink-ring 324 of the sticky lint structure 3 is inserted into the perforation 16, and then the lint removing assembly is installed, i.e. the mounting holder 13 is fixed in the body 1 by a buckle or a thread. Since the position of the pin 131 is matched with the position of the shrink-ring 324, at this time, the pin 131 can also be inserted into the shrink-ring 324 and fix the fixed portion in the handle 2 by cooperating with the wall of the body 1 and the perforation 16. The lint removing device further includes the sticky lint roller 4, wherein the sticky lint roller 4 is sleeved on the protruding portion and restricted by the protruding portion. In addition, the sticky lint roller 4 is able to extend out of the handle 2 following with the protruding portion, and serve as a sticky lint component. The sticky lint roller 4 can be stored in the handle 2 following with the protruding portion when the sticky lint roller 4 is not in use.

The fixed portion includes the self-locking switch 34, and the protruding portion includes the lock catch 311 matched with the self-locking switch 34. The self-locking switch 34 is existing in the prior art. The self-locking switch 34 enters a locked state and an unlocked state after being continuously pressed. The self-locking switch 34 is matched with the lock catch 311 of the protruding portion. In this way, the lock catch 311 of the protruding portion and the self-locking switch 34 can be locked and unlocked by continuously pressing the protruding portion at one end of the handle 2 having the opening. Therefore, the integrity of the housing of the handle 2 has remained, and the handle 2 is easily manufactured and has better mechanical properties.

The present disclosure further provides an embodiment of a suction type lint removing device. The lint removing assembly further includes the motor 15 and the suction type fan 14. The motor 15 provides the driving force to the suction type fan 14 and the blade of the lint removing device. The trimmed lint is sucked into and stored in the body 1. The mounting holder 13 is matched with the wall of the body 1 to divide the inner chamber of the body 1 into the first chamber 11 and the second chamber 12. The suction type fan 14 is installed inside the first chamber 11. The pin 131 is arranged inside the second chamber 12, and the perforation 16 and the second chamber 12 communicate. The suction type fan 14 is able to suck the lint trimmed by the lint removing device into an interior of the lint removing device, Specifically, the lint trimmed by the lint removing device is sucked into the first chamber 11, and an interior of the body 1 is divided by the mounting holder 13 into the first chamber 11 and the second chamber 12. The sticky lint structure 3 and the connecting fixed structure of the mounting holder 13 are arranged in a corresponding area of the second chamber 12, so as to prevent the sucked lint from being blown into an interior of the handle 2.

There is no need to fully seal the mounting holder 13 and the wall of the body 1, and there may be a gap between the mounting holder 13 and the wall of the body 1. Nonetheless, the size of the gap should be small enough to allow the sucked lint to not be blown from the first chamber 11 into the second chamber 12.

Figure 8:
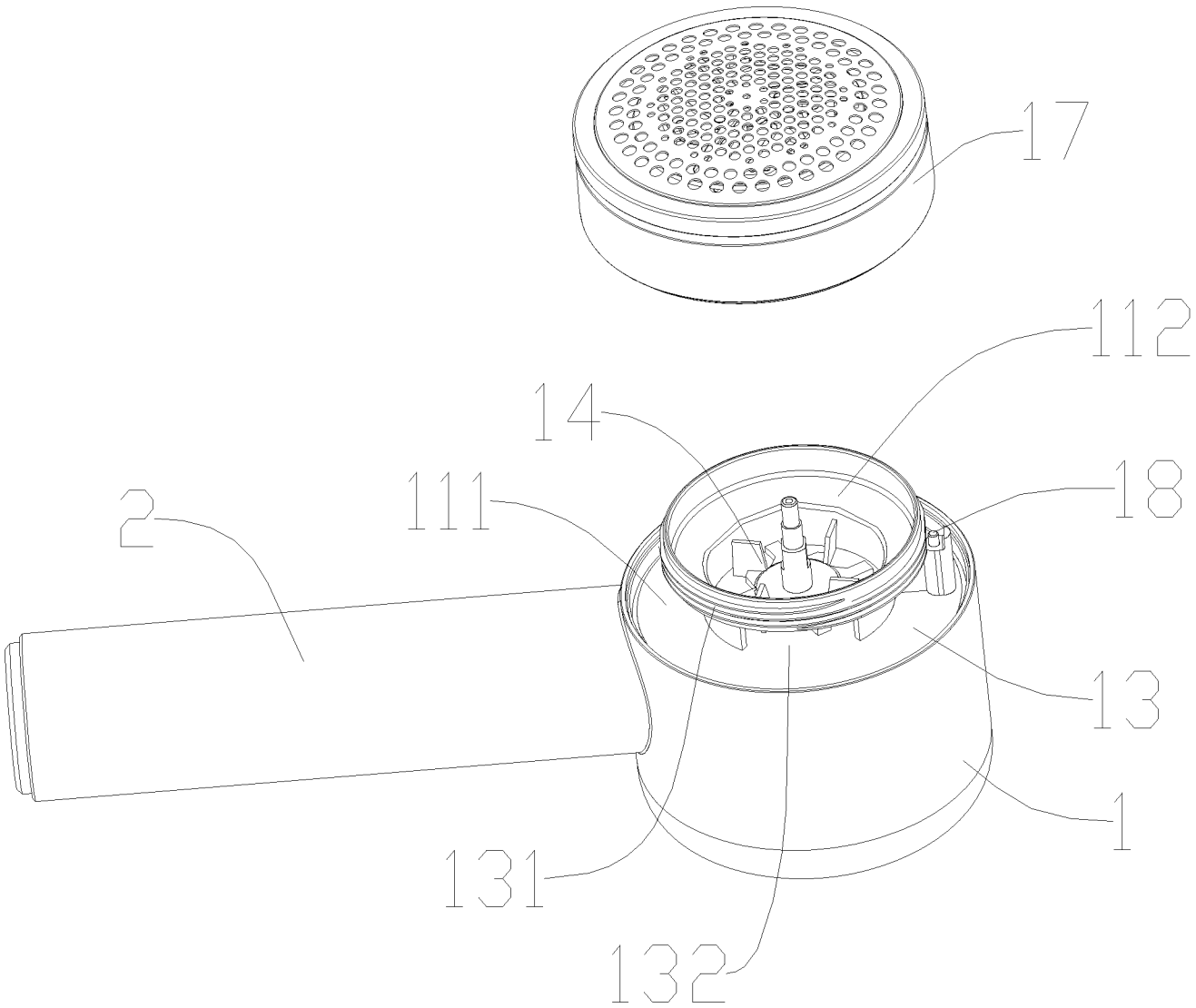
FIG. 8 is an exploded view of the lint removing device of the present disclosure in another state.
Figure 9:
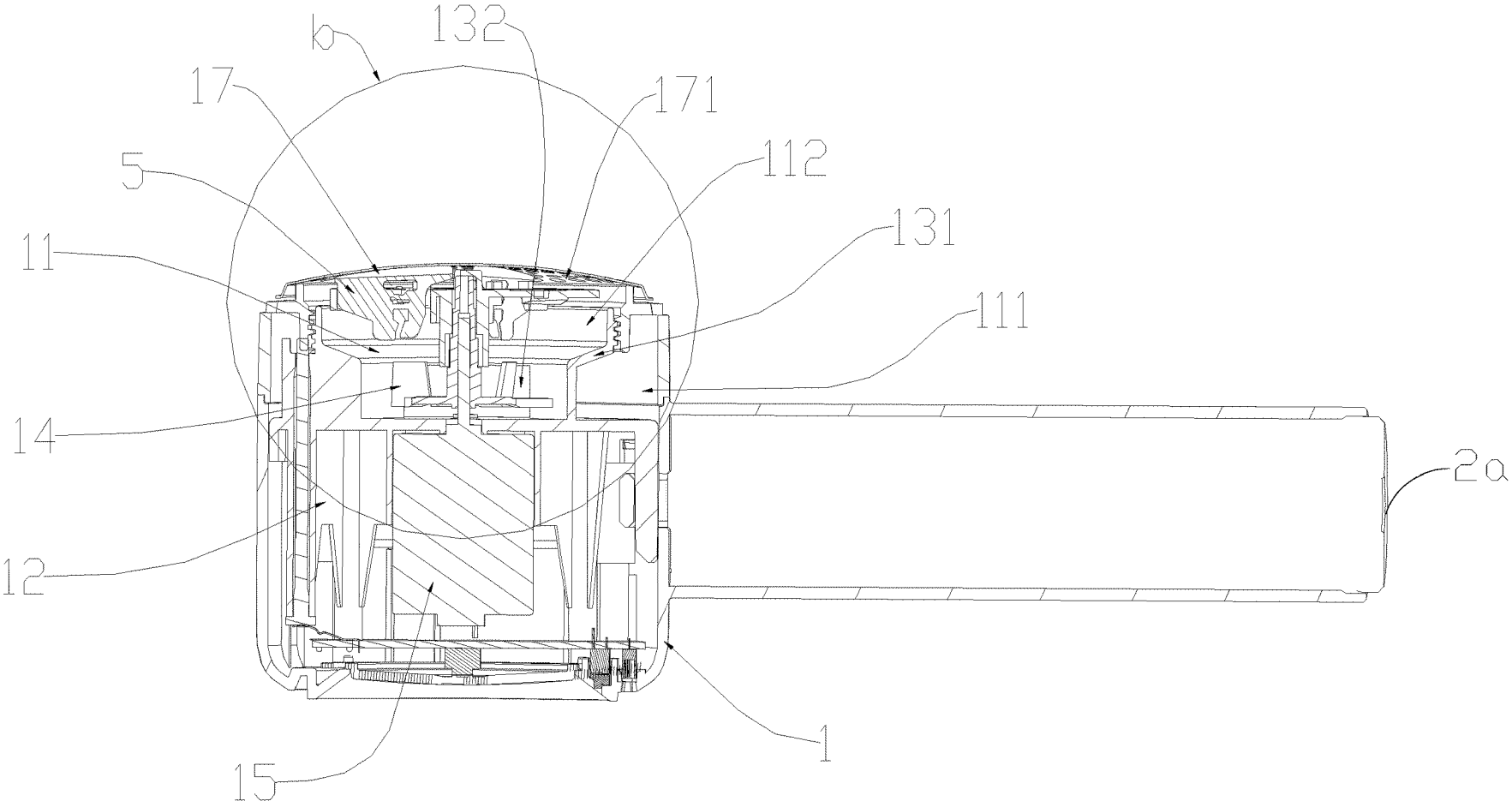
FIG. 9 is a cross-sectional view of the body of the lint removing device of the present disclosure.

As shown in FIG. 8, the threaded fixed holder 131 is formed on the mounting holder 13 and used for installing the cover 17. According to FIG. 2, when the cover 17 is mounted on the threaded fixed holder 131, the first chamber 11 can be divided into the two chambers, i.e. the third chamber 112 configured to contain the suction type fan 14 and the blade and the fourth chamber 111 configured to store the sucked lint. Furthermore, the passage 132 is formed on the threaded fixed holder 131, so as to blow the sucked lint into the fourth chamber 111 through the passage 132 and is stored in the fourth chamber 111.

At this time, the fourth chamber 111 serves as a chamber for storing the lint. Although the fourth chamber 111 has a much smaller size than the existing product, the lint removing device meets the requirement for repeatedly trimming the clothing. When the stored lint is excessive, the user can open the cover 17 and purge the lint.

Figure 7:
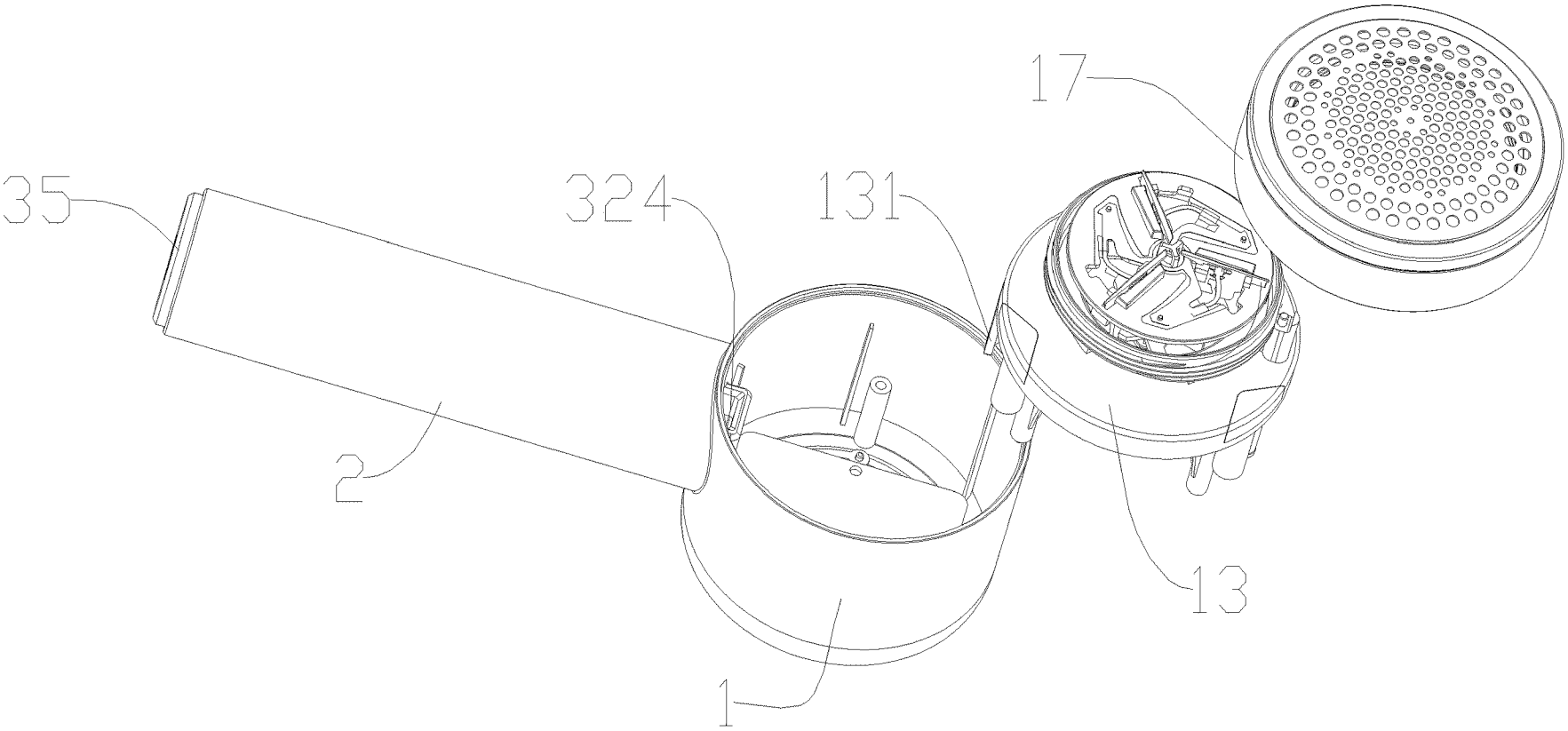
FIG. 7 is an exploded view of the lint removing device of the present disclosure.

However, in the structure of the lint removing device of the present disclosure as shown in FIG. 7, when the cover 17 is opened, the blade is also exposed outside. If the blade is started at this time, then a severe consequence may be caused. Therefore, the lint removing device further includes a cover protective structure. As shown in FIG. 8, the trigger lever 18 is arranged at a position adjacent to the threaded mounting holder 131. When the cover 17 is mounted on the threaded mounting mount 131, the trigger lever 18 can be pressed to trigger the internal switch, and then the motor 15 is turned on and drives the blade to rotate normally. In contrast, the blade cannot be started after the cover 17 is removed. In addition, the triggered internal switch is a common switch, e.g. a micro switch or other switches capable of achieving this function.

As shown in FIG. 1, the protruding portion further includes the pressing portion 35, which is readily pressed. When the sticky lint structure 3 is in use, the pressing portion 35 is pressed to allow the protruding portion to fall from the self-locking switch 34, and the protruding portion can naturally extend out of the handle 2 from the opening of the handle 2 and achieve the extended function.

Therefore, there is a demand for the position of the pressing portion 35, namely, the pressing portion 35 should be arranged on the protruding portion, and at a position where the pressing portion is adjacent to the opening of the handle 2 and is obviously able to be pressed when the protruding portion is locked on the self-locking switch 34. The position includes a position extending from the opening, a position flushing with the opening, a position sinking into the handle 2, or other positions where the pressing portion 35 can be pressed. Preferably, the pressing portion 35 extends from the opening, which is quite convenient for a pressing operation. The pressing portion 35 shown in FIG. 1 extends from the opening of the handle 2. In this way, when the protruding portion is pushed into the handle 2 and fixed, the pressing portion 35 can still readily be pressed, without being obstructed by the outer housing of the handle 2.

Figure 2:
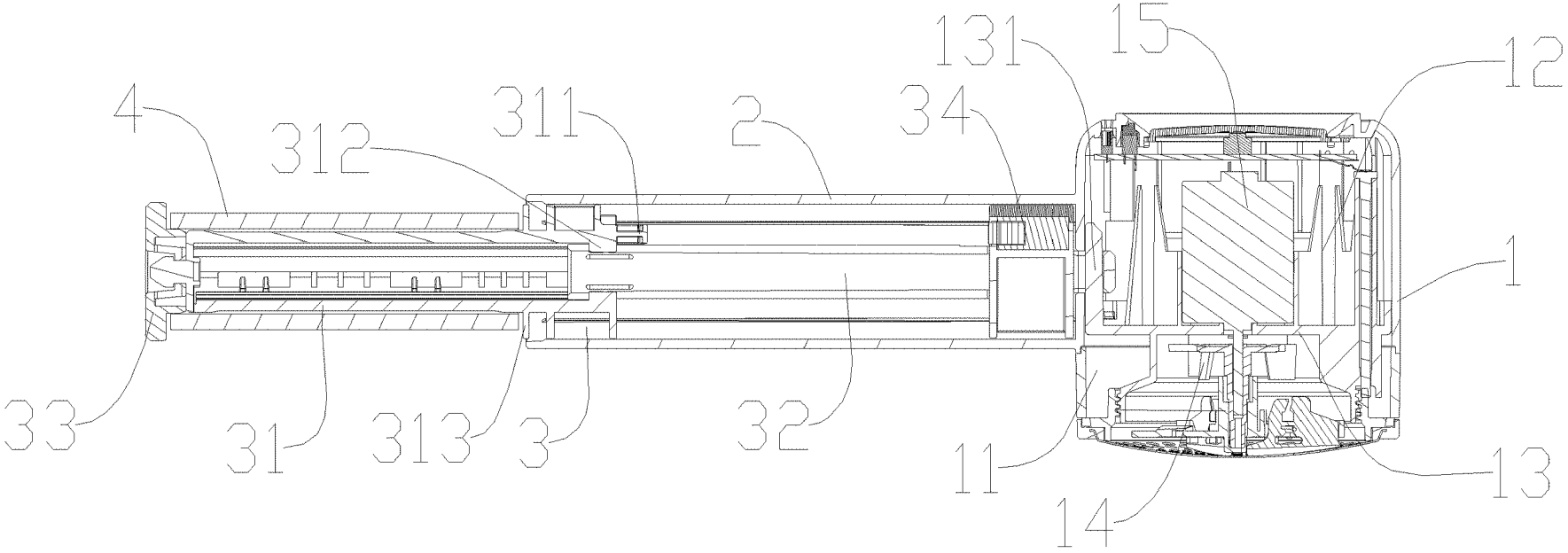
FIG. 2 is a cross-sectional view showing the lint removing device of the present disclosure when the protruding portion is extended.
Figure 3:
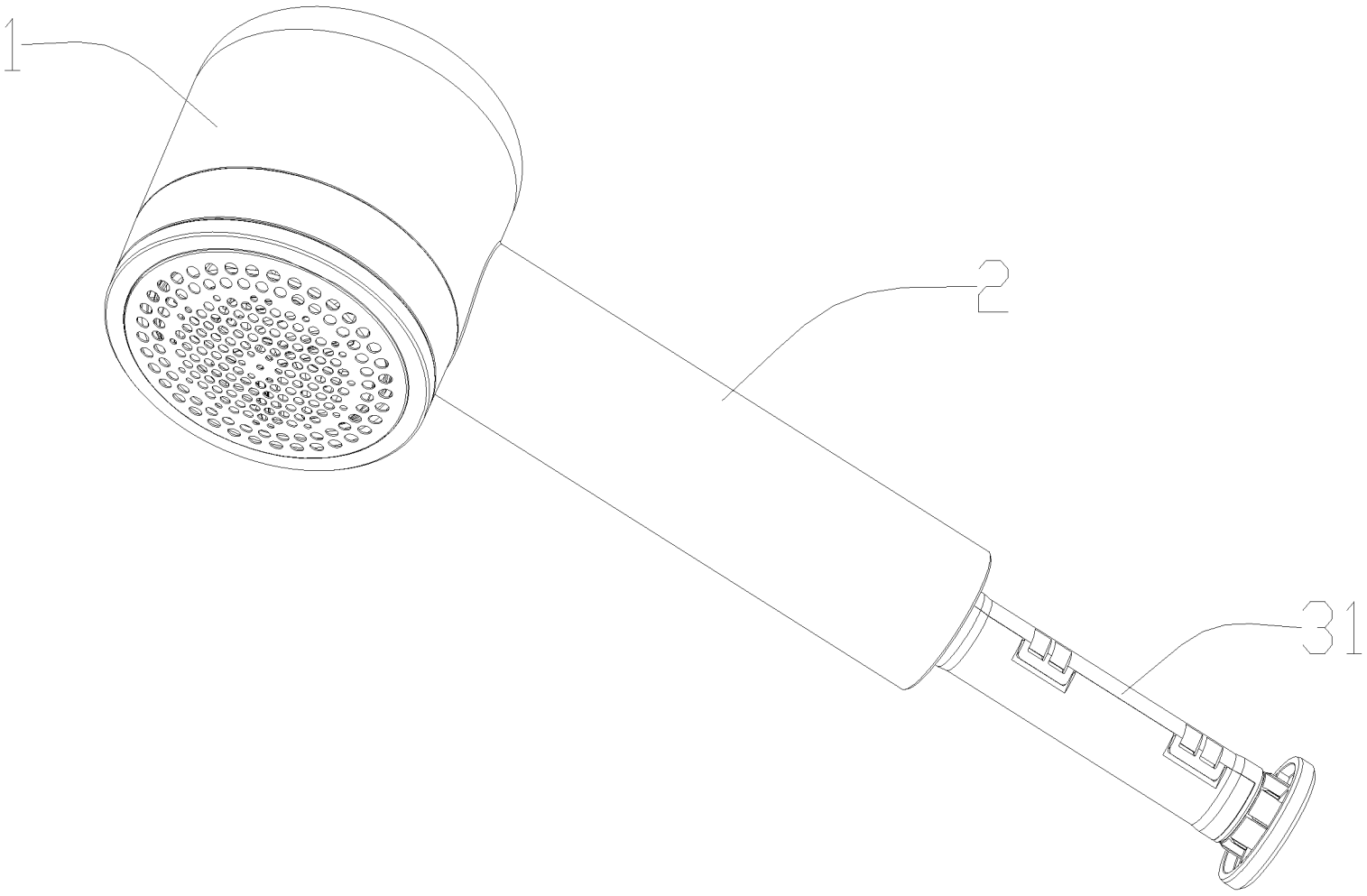
FIG. 3 is a perspective view showing the lint removing device of the present disclosure when the protruding portion is extended.

After the pressing portion 35 is being pressed, the protruding portion of the sticky lint structure 3 can extend out of the handle 2 from the opening. As shown in FIGS. 2 and 3, the protruding portion can extend out of the handle 2 after the pressing portion 35 is pressed. The protruding portion includes a guiding structure, and the guiding structure acts on the fixed portion. The guiding structure is matched with the fixed portion to make the protruding portion move in a direction, and can also prevent the protruding portion from randomly shaking in the handle 2.

Figure 4:
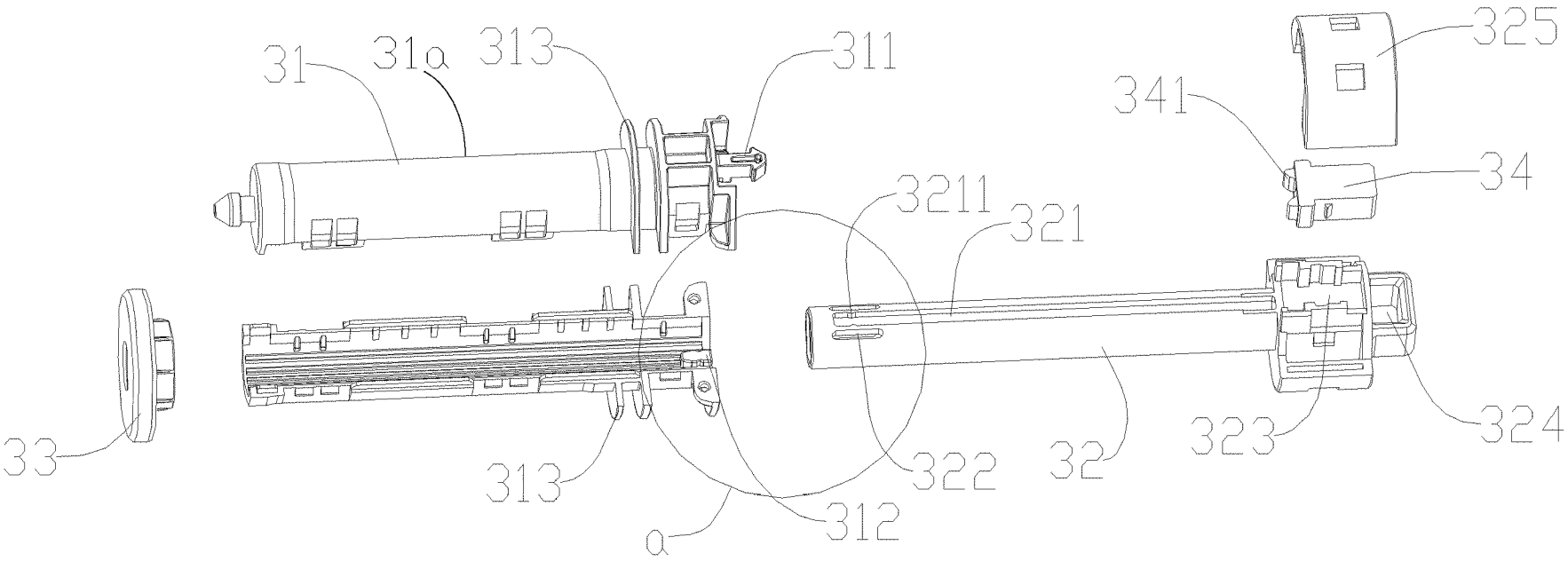
FIG. 4 is an exploded view of an embodiment showing an extended functional structure of the present disclosure.

As shown in FIG. 2 and FIG. 4, the guiding structure is the guiding protrusion 312, and the guiding protrusion 312 extends toward the fixed portion. The guiding groove 321 matched with the guiding protrusion 312 is arranged on the fixed portion, allowing the protruding portion to slide steadily in the handle 2. Moreover, in order to prevent the protruding portion from shaking in the handle 2, the ring surface 313 matched with the inside dimension of the handle 2 is arranged on the protruding portion.

Further, the guiding protrusion 312 may also extend toward the inner surface of the handle 2, and the guiding groove matched with the guide protrusion 312 is arranged on the inner surface of the handle 2.

As shown in FIG. 4, the fixed portion further includes the support cylinder 32, the protruding portion is sleeved on the support cylinder 32 in a sliding manner, and the support cylinder 32 is provided with the guiding groove 321 matched with the guiding protrusion 312. In addition, the protruding portion can also be restricted in the handle 2 so that the protruding portion cannot be completely pulled out. The positioning protrusion 322 is arranged at the end of the guiding groove 321, and is used to match with the guiding protrusion 312 so as to position the protruding portion. The functional groove 3211 is arranged beside the positioning protrusion 322 of the support cylinder 32 and is used for increasing the elasticity of the positioning protrusion 322, so that the guiding protrusion 312 can be readily matched with the positioning protrusion 322.

The lint removing device further includes a functional component, wherein the protruding portion is the functional component, or the functional component is fixed to the protruding portion.

When the functional component is a sticky lint component, the sticky lint component is sleeved on the protruding portion. As a result, the lint removing device possesses a lint sticking function. When the functional component is an anti-static brush, the protruding portion is the anti-static brush, which can be stored in the handle 2 when not in use, and can be pulled out to eliminate the static electricity on the clothing during use.

Figure 5:
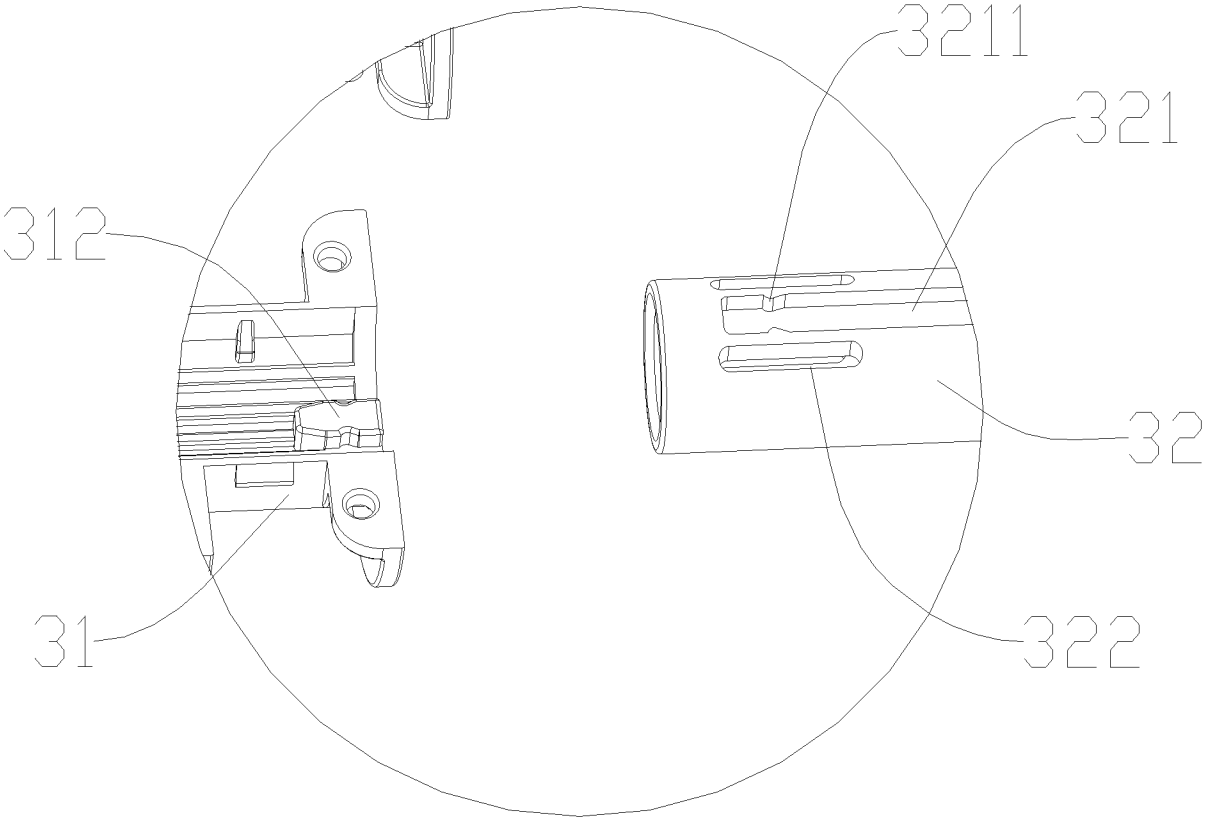
FIG. 5 is a partially enlarged view of the portion "a" in FIG. 4.
Figure 6:
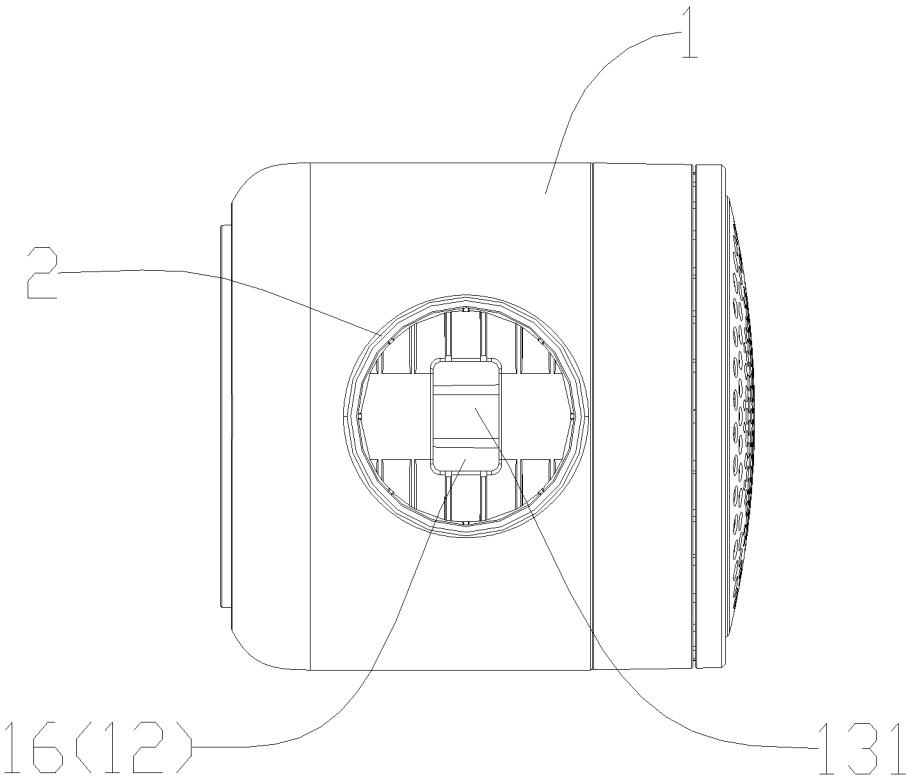
FIG. 6 is a side elevational view of a handle and a body of the present disclosure.

Based on this, as shown in FIGS. 4 to 5, a more specific embodiment of a sticky lint structure is provided.

The sticky lint structure includes the protruding portion and the fixed portion. The protruding portion includes the sleeve 31 and the limiting cover 33. The limiting cover 33 is fixed on one side of the sleeve 31, and the other side of the sleeve 31 is provided with the lock catch 311. The ring surface 313 matched with the inner surface of the handle 2 is arranged on the outer surface of the sleeve 31. As shown in the FIGS. 4 to 5, the sleeve 31 is formed by splicing two parts. The guiding protrusion 312 is arranged on the inner surface of the sleeve 31. The sleeve 31 is designed as a splicing structure, thereby facilitating to sleeve the protrusion 312 on the fixed portion. After the protruding portion is installed in the handle 2, the limiting cover 33 can also serve as the pressing portion 35 of the protruding portion so as to facilitate the pressing operation.

The fixed portion includes the support cylinder 32 and the self-locking switch 34. One end of the support cylinder 32 is provided with the shrink-ring 324. Moreover, the self-locking switch 34 is arranged adjacent to the shrink-ring 324. As shown in FIG. 4, the support cylinder 32 is provided with the mounting holder 323 for the installation of the self-locking switch 34 and the mounting cover 325. The self-locking switch 34 is tightly covered on the support cylinder 32, and the guiding groove 321 is arranged on the surface of the support cylinder 32 from the self-locking switch 34 to the other end of the support cylinder 32. In addition, the guiding groove 321 is further provided with the structure of the positioning protrusion 322 and the functional groove 3211 as described above.

Specifically, the self-locking switch 34 includes the claw 341 for grasping the lock catch 311. The claw 341 alternately performs the action of grasping and loosening the lock catch 311 after being continuously abutted by the lock catch 311, thereby fixing or unfixing the sleeve 31 in the handle 2.

A mounting area 31*a* for mounting the sticky lint roller 4 is formed on the sleeve 31, and a limiting part for restricting the sticky lint roller 4 is provided on both sides of the mounting area. Specifically, the limiting part includes the ring surface 313 and the limiting cover 33. The limiting cover 33 is detachably fixed on the sleeve 31. When the sticky lint roller 4 needs to be replaced, the limiting cover 33 can be directly removed, thereby the sticky lint roller 4 can be readily replaced. Obviously, the ring surface 313 can match with the inner wall of the handle 2 in addition to restricting the position of the sticky lint roller 4, so as to prevent the protruding portion from shaking in the handle 2

In order to make the most of the sticky lint roller 4, when the sleeve 31 is extended to a maximum position outside the handle 2, the mounting area of the sticky lint roller 4 can at least completely extend outside the handle 2. Namely, when the guiding protrusion 312 of the sleeve is moved to a position to match the positioning protrusion 322 and is positioned and fixed, the mounting area can at least completely extend out from the handle 2 to form an extended state as shown in FIG. 2.

Further, as a more preferable solution, the spring is arranged in the support cylinder 32 or between the support cylinder 32 and the protruding portion, and one end of the spring abuts against the protruding portion. The spring can provide an elastic force for supporting the protruding portion, and can be popped up after the self-locking switch 34 is unlocked, so that the protruding portion can be designed with more installation states with the handle. If the protruding portion is designed to be hidden, the protruding portion is placed in the handle and cannot be readily removed by hands, while the protruding portion can be pushed out the handle after be unlocked owing to the spring.

As for the above-mentioned structure in the foregoing embodiment, the spring should be arranged inside the support cylinder 32 to protect the matching of the guiding protrusion 312 and the guide groove 321 from interferences.

The lint removing device according to the present disclosure includes the body 1 of the lint removing device and the handle 2 connected to the body 1 on one end. The handle 2 is hollow, the other end of the handle has an opening. The extended functional structure 3 is installed after being inserted from the opening. In order to avoid affecting the installation of the extended functional structure 3 in the handle 2, the conventional lint removing assemblies are integrally arranged in the body. As a result, the handle of the present disclosure is not provided with any conventional lint removing assembly. The extended functional structure 3 includes the fixed portion, the protruding portion, and the sticky lint roller 4. The protruding portion extends from the opening to the outside of the handle 2 for the lint sticking function, so the extended functional structure 3 of the present disclosure is retractable. The extended functional structure 3 can be contained inside the handle 2 when the user does not use the extended function. The lint removing device of the present disclosure has a similar overall appearance as the conventional lint removing device, while fully utilizing the space inside the handle, thereby expanding other functions of the lint removing device in addition to trimming lint.

The lint removing assembly of the present disclosure further includes the blade. The blade is matched with the cover 17, and the cover 17 is provided with a small hole. When the lint is removed, the cover 17 faces toward the fabric that needs to remove the lint, allowing the lint to pass through the small hole. Then, the lint is trimmed by the blade, so as to achieve the lint removing function.

Figure 10:
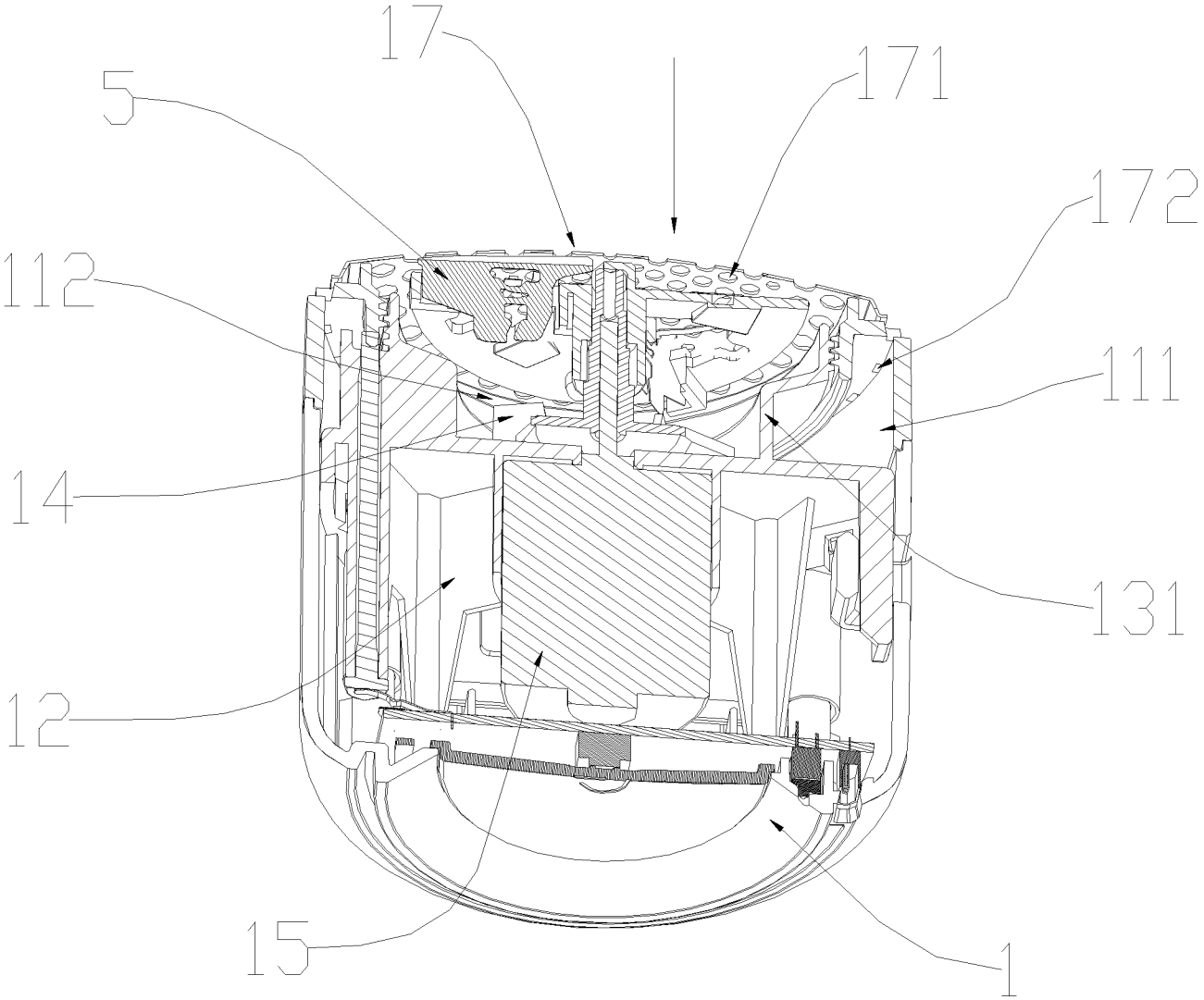
FIG. 10 is a cross-sectional view of the body of the lint removing device of the present disclosure in an inclined state.
Figure 14:
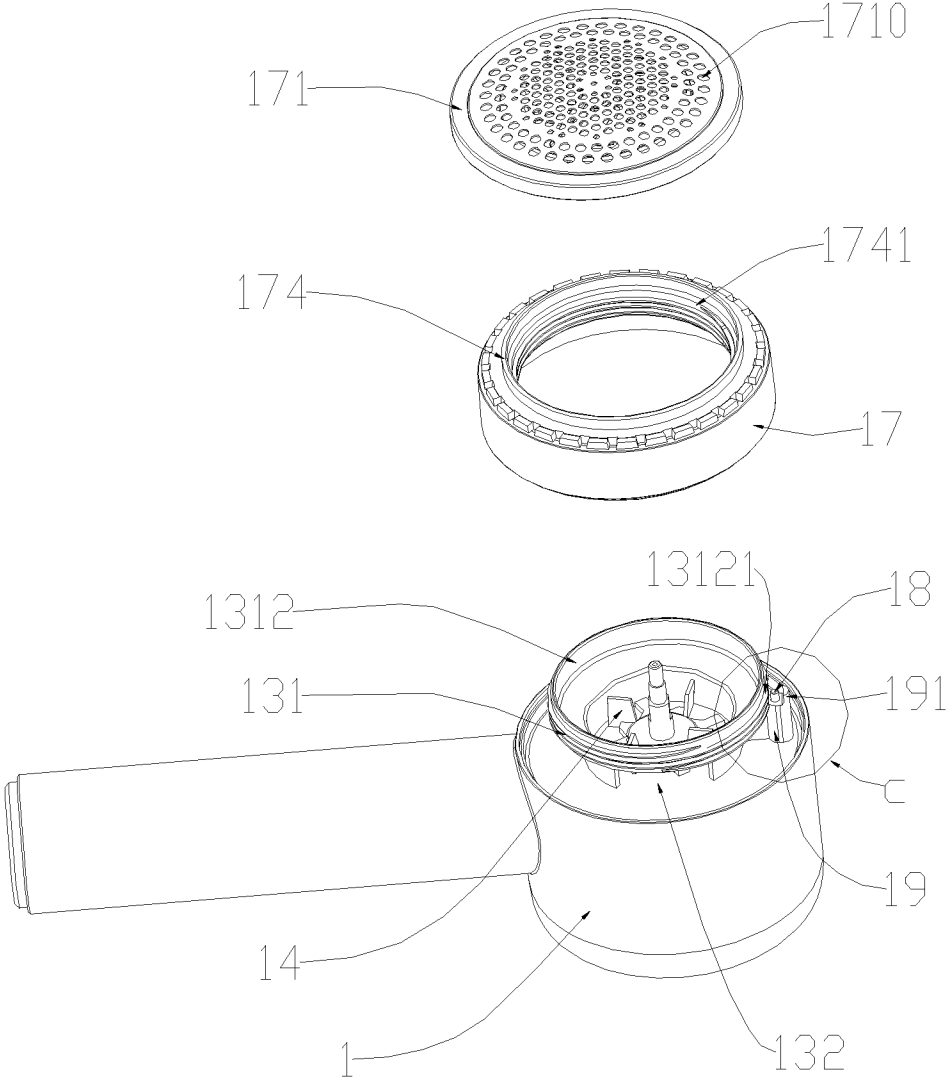
FIG. 14 is an exploded view of the body of the lint removing device of the present disclosure.

As shown in FIGS. 9, 10 and 14, the lint removing device includes the body 1. The body 1 is divided into the first chamber 11 and the second chamber 12. The first chamber 11 includes the blade 4, the suction type fan 14 and the cover 17 having the blade mesh 171. The second chamber 12 is provided with the motor 15, and a drive shaft of the motor 15 is inserted into the first chamber 11 from the second chamber 12 to be coaxially connected to the blade 4 and the suction type fan 14. The first chamber 11 is further provided with the threaded fixed holder 131, and the threaded fixed holder 131 has a function of guiding airflow. The threaded fixed holder 131 is arranged below the blade 4 and is arranged around the suction type fan 14 to divide the first chamber 11 into the third chamber 112 inside the threaded fixed holder 131 and the fourth chamber 111 outside the threaded fixed holder 131. The threaded fixed holder 131 is provided with the passage 132 connecting the third chamber 112 and the fourth chamber 111. The cover 17 covers the first chamber 11 and is detachably connected to the threaded fixed holder 131, and the cover 17 is further provided with the vent holes 172 on the fourth chamber 111.

Figure 11:
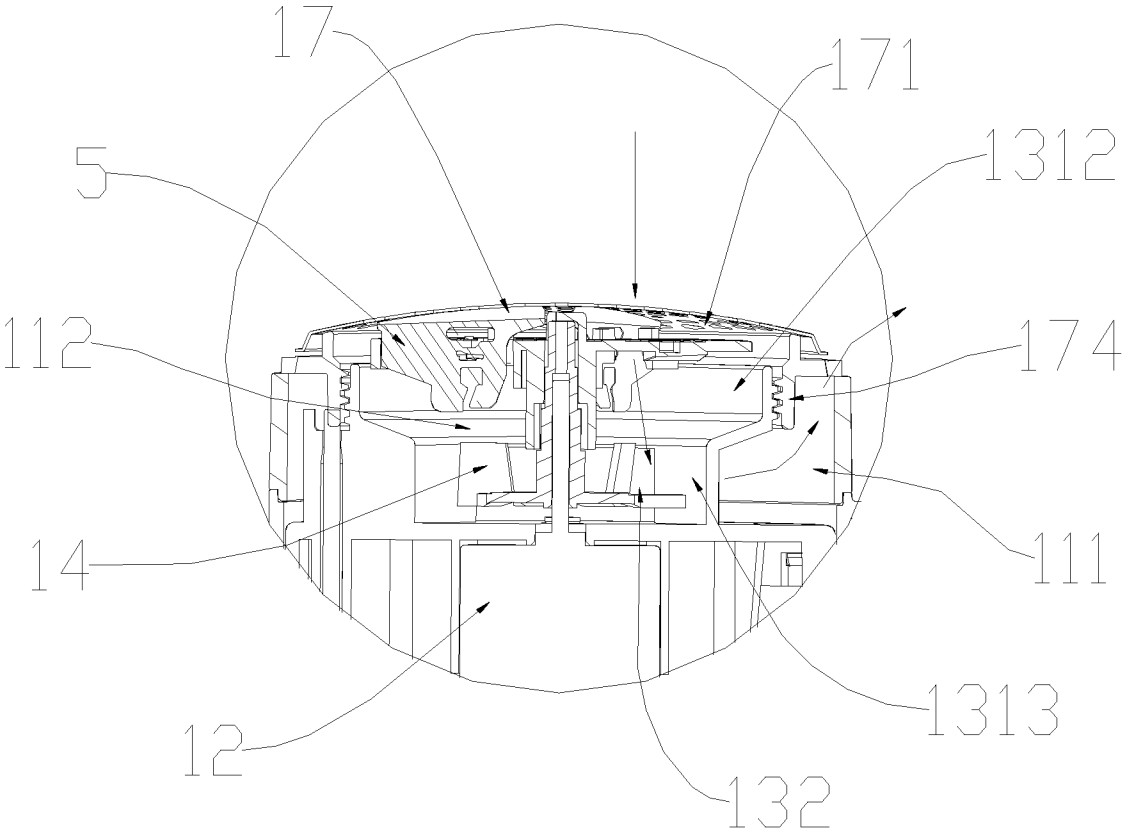
FIG. 11 is a partially enlarged view of the portion "b" in FIG. 9.

The air passage structure of the lint removing device is located in the first chamber 11. As shown in FIG. 11 (the arrow shows an air flowing path), the air flowing path includes: the air enters the third chamber 112 through the blade mesh 171, and then enters the fourth chamber 111 through the passage 132 on the threaded fixed holder 131, and finally discharges from the vent holes 172 on the cover 17. The whole air passage structure has a short path within the first chamber 11, which economizes the occupied internal space. Thus, the entire device has a small size, and is convenient for carrying and storage. The motor 15 that has a lower power and less noise can be selected owing to the short path of the air passage structure, which effectively reduces the energy consumption and noise.

Since the first chamber 11 and the second chamber 12 are separately arranged, the lint and the debris is effectively prevented from entering the second chamber 12, and cleanliness and hygiene of the motor 15 and other internal parts can be ensured, so as to assure a normal operation of the entire device.

The trimmed lint and the debris are sucked into the third chamber 112 through the blade mesh 171, and are dispersed by the suction type fan 14, and then enter the fourth chamber 111 outside the threaded fixed holder 131 through the passage 132 of the threaded fixed holder 131 on the side. There is no deposited corner owing to the short path. The mesh cover structure of the prior art is eliminated, so it is convenient for cleaning. The lint and the debris of the fourth chamber 111 can be emptied, provided that the cover is opened to purge the lint and the debris, which is convenient to clean, and improves the user experience.

Figure 13:
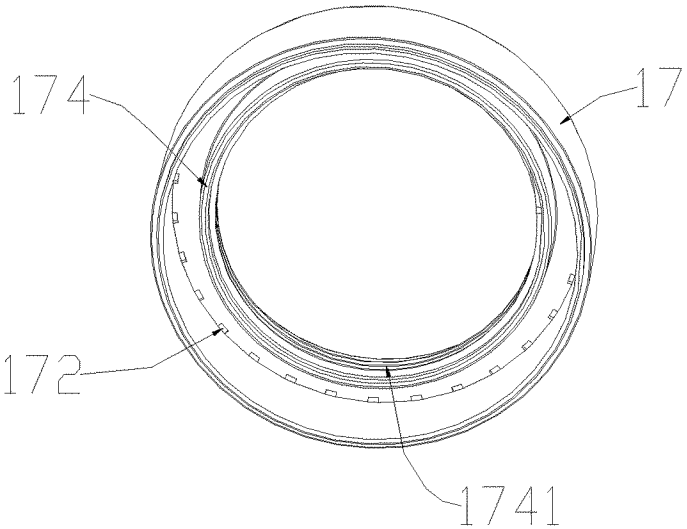
FIG. 13 is a second perspective view showing the cover of the lint removing device of the present disclosure.
Figure 12:
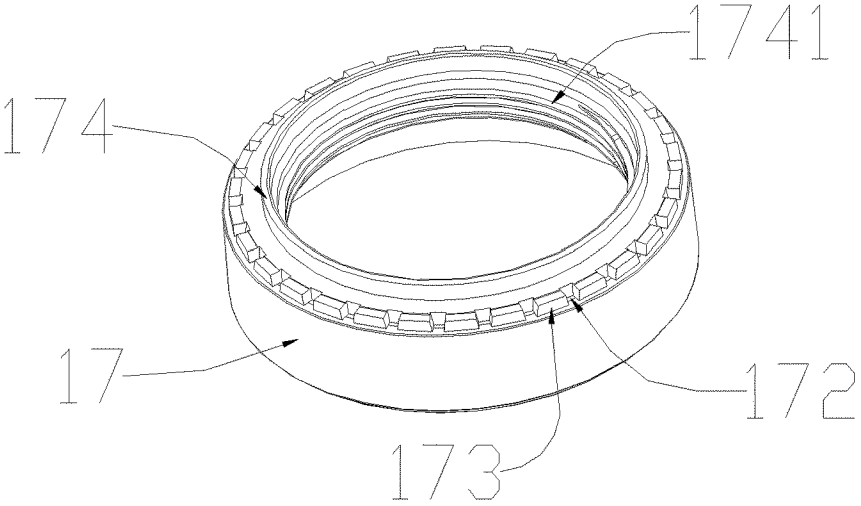
FIG. 12 is a first perspective view showing a cover of the lint removing device of the present disclosure.

Where, as shown in FIGS. 12 to 13, the plurality of vent holes 172 is provided on the cover 17, and are arranged around a periphery of a top of the cover 17. The vent holes 172 are located above the fourth chamber 111, and play a role of filtering when the cover 17 is closed. The air can be discharged to realize the convection of the internal air. Moreover, the lint and the debris can be blocked from being leaked out, and are stored in the fourth chamber 111.

The shape of the vent holes 172 is optimized. As shown in FIG. 12, the periphery of the top of the cover 17 is a gear-shaped structure, and the cover 17 includes the bumps 173 surrounding the periphery and spaced apart to each other. The vent holes 172 are arranged between the adjacent bumps 173, so that the vent holes 172 are arranged more compactly, thereby enhancing the filtering function, and improving the venting effect.

Based on the foregoing description, the bump 173 has an inverted trapezoid shape, so that the vent passage is gradually expanded between the bumps 173, thereby expanding the air outlet outside the vent holes 172, enhancing the air motion effect, and improving the venting performance.

The structure of the cover 17 is optimized. As shown in FIG. 14, the cover 17 is provided with the convex ring 174 for fixing the blade mesh 171, and the internal thread 1741 meshed with the threaded fixed holder 131 is arranged in the convex ring 174.

Preferably, the multilayer hole 1710 is annularly arranged in the blade mesh 171, and the multilayer hole 1710 is located in the opening of the third chamber 112, so the air or the lint and the debris are directly sucked into the third chamber 112. The multilayer hole 1710 forms the convection with the vent holes 172 of the cover 17 located on the fourth chamber 111, and the airflow and the motion path of lint and debris are controlled to improve the operation effect of the air passage.

Figure 15:
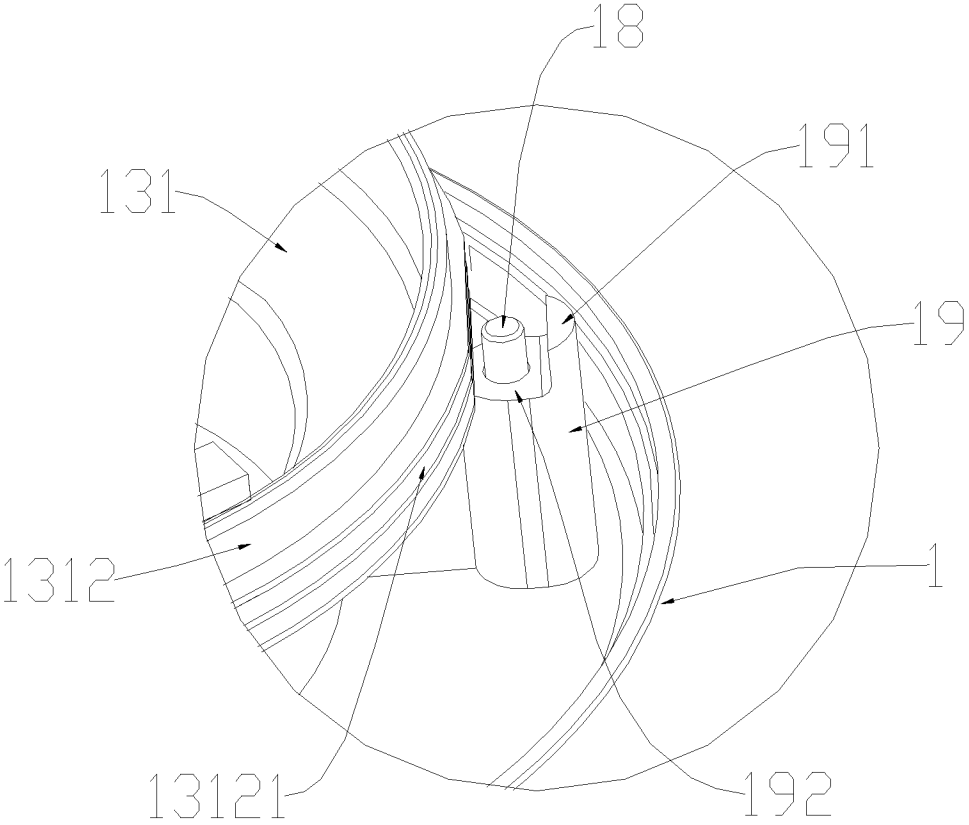
FIG. 15 is a partially enlarged view of the portion "c" in FIG. 14.

Correspondingly, as shown in FIGS. 11, 14, 15, the threaded mounting holder 131 includes the upper ring 1312 having a large diameter and the lower ring 1313 having a small diameter. The upper ring 1312 is sleeved on and connected to the blade mesh 171 on the cover 17, and the blade 4 is stored in the upper ring 1312. The outer wall of the upper ring 1312 is provided with the external thread 13121 meshed with the convex ring 174. The suction type fan 14 is stored in the lower ring 1313, and the lower ring 1313 is provided with the passage 132 connecting the third chamber 112 and the fourth chamber 111.

On one aspect, the threaded fixed holder 131 is a structure having a wide upper portion and a narrow lower portion, and the structure is composed of the upper ring 1312 and the lower ring 1313, thereby effectively improving the concentration effect. The lint and the debris trimmed by the blade 4 are sucked from the wider upper ring 1312, and are concentrated into the narrower lower ring 1313, and then are driven by the suction type fan 14 to move from the lateral passage 132 into the fourth chamber 111.

On the other aspect, the upper ring 1312 is provided with the corresponding external thread 13121 meshed with the convex ring 174 on the cover 17, so as to form a detachable threaded connection structure, which is convenient for the user to remove the cover 17 and clean the debris in the fourth chamber 111.

In order to match the detachable cover structure, as shown in FIGS. 14 to 15, the lint removing device of the present disclosure further includes a safety device for detecting the installation state of the cover 17. The safety device is the trigger lever 18 arranged outside the threaded mounting holder 131, and the trigger lever 18 is connected to a power supply circuit of the lint removing device. After the cover 17 is completely installed and fixed, the power supply is turned on, so as to avoid blade 4 starting while the cover 17 is not installed securely, thereby avoiding causing the injury, and improving the safety control effect.

The specific structure of the safety device is as follows. The threaded fixed holder 131 is provided with the fixed support 19 of the trigger lever 18. The top surface of the fixed support 19 is lower than the external thread 13121 of the upper ring 1312. The trigger lever 18 passes through the top surface of the fixed support 19 and contacts and is matched with the bottom of the convex ring 174 of the cover 17. In practical applications, when the user is installing the cover 17, the convex ring 174 of the cover 17 needs to be screwed with the threaded fixed holder 131, so that the cover 17 is completely fixed on the first chamber 11. During the installation of the cover 17, when the bottom of the convex ring 174 of the cover 17 contacts the trigger lever 18, the trigger lever 18 is pressed to turn on the internal power supply. At this time, the user can start the motor 15 to rotate, and the lint removing device operates normally.

Based on the above-mentioned structure, as shown in FIG. 15, the top surface of the fixed support 19 is further provided with the limiting block 191. The limiting block 191 is spaced apart from the upper ring 1312 to form the groove 192 that is used to embed the convex ring 174 thereto. The trigger lever 18 passes through the top surface of the fixed support 19 in the groove 192. When the cover 17 is being installed, the convex ring 174 of the cover 17 is screwed outside the upper ring 1312, and the convex ring 174 is restricted to keep rotating in the groove, so as to make the convex ring 174 accurately contact the trigger lever 18. The trigger lever 18 is pressed down to trigger and turn on the power supply, thereby improving the triggering accuracy of the cover 17 and the trigger lever 18, and enhancing the control effect.

According to the disclosure and teaching of the aforementioned description, some variations and modifications may be made to above embodiments by those skilled in the art. Therefore, the present disclosure is not limited to the specific embodiments disclosed and described above, and those modifications and variations of the present disclosure are intended to fall within the scope of the claims of the present disclosure. In addition, although some specific terminologies are used in the specification, while these terminologies are intended to illustrate conveniently instead of constituting any limitation to the present disclosure.

What is claimed is:

1. A lint removing device, comprising a body, a handle connected to the body, and a lint removing assembly including a blade, wherein the lint removing assembly is arranged in the body; the handle is hollow; an opening is provided at a first end of the handle, and a second end of the handle is connected to an outer wall of the body; the handle comprises an extended functional structure; the extended functional structure comprises a fixed portion and a protruding portion, wherein the fixed portion is placed inside the handle, the protruding portion extends out of the handle from the opening and achieves an extended function, and the protruding portion is fixed in the handle by the fixed portion after the protruding portion is retracted in the handle, wherein the fixed portion comprises a self-locking switch, the protruding portion comprises a lock catch and a pressing portion, the lock catch is matched with the self-locking switch, and the pressing portion is configured to be pressed.

2. The lint removing device according to claim 1, wherein the lint removing assembly comprises a mounting holder; the mounting holder is fixed inside the body; a wall of the body is provided with a perforation at a position corresponding to the handle; the fixed portion comprises a shrink-ring, wherein the shrink-ring passes through the perforation; the mounting holder is provided with a pin, and the pin is inserted into the shrink-ring to fix the fixed portion in the lint removing device.

3. The lint removing device according to claim 2, wherein the lint removing assembly further comprises a suction type fan; the mounting holder is matched with the wall of the body to divide an inner chamber of the body into a first chamber and a second chamber; the suction type fan is installed inside the first chamber; the pin is arranged inside the second chamber; and the perforation and the second chamber communicate.

4. A lint removing device, comprising a body, a handle connected to the body, and a lint removing assembly including a blade, wherein the lint removing assembly is arranged in the body; the handle is hollow; an opening is provided at a first end of the handle, and a second end of the handle is connected to an outer wall of the body; the handle comprises an extended functional structure; the extended functional structure comprises a fixed portion and a protruding portion, wherein the fixed portion is placed inside the handle, the protruding portion extends out of the handle from the opening and achieves an extended function, and the protruding portion is fixed in the handle by the fixed portion after the protruding portion is retracted in the handle, wherein the protruding portion comprises a guiding structure, and the guiding structure acts on the handle or the fixed portion.

5. The lint removing device according to claim 4, wherein the handle or the fixed portion is provided with a guiding groove; the guiding groove is provided with a positioning protrusion at the first end of the handle having the opening; the guiding structure is matched with the guiding groove and the positioning protrusion to enable the guiding structure to slide in the guiding groove and to be positioned and fixed by the positioning protrusion.

6. A lint removing device, comprising a body, a handle connected to the body, and a lint removing assembly including a blade, wherein the lint removing assembly is arranged in the body; the handle is hollow; an opening is provided at a first end of the handle, and a second end of the handle is connected to an outer wall of the body; the handle comprises an extended functional structure; the extended functional structure comprises a fixed portion and a protruding portion, wherein the fixed portion is placed inside the handle, the protruding portion extends out of the handle from the opening and achieves an extended function, and the protruding portion is fixed in the handle by the fixed portion after the protruding portion is retracted in the handle, wherein the lint removing device further comprises a sticky lint roller, wherein the sticky lint roller is sleeved outside the protruding portion and is restricted by the protruding portion, and the sticky lint roller extends out of the handle and is retracted in the handle following with the protruding portion.

7. The lint removing device according to claim 6, wherein the fixed portion comprises a support cylinder, and the protruding portion is sleeved on the support cylinder in a sliding manner.

8. The lint removing device according to claim 7, wherein the protruding portion is provided with a guiding structure toward the support cylinder, and the guiding structure is matched with the support cylinder to guide the protruding portion.

9. The lint removing device according to claim 8, wherein the support cylinder is provided with a guiding groove; the guiding groove is provided with a positioning protrusion at the first end of the handle having the opening; the guiding structure is matched with the guiding groove and the positioning protrusion to enable the guiding structure to slide in the guiding groove and to be positioned and fixed by the positioning protrusion.

10. The lint removing device according to claim 7, wherein the protruding portion further comprises a mounting area used for installing the sticky lint roller, and a limiting part configured to restrict a position of the sticky lint roller is arranged on each of two sides of the mounting area.

11. The lint removing device according to claim 10, wherein the limiting part on one of the two sides of the mounting area is detachable.

* * * * *